United States Patent [19]

Kobayashi et al.

[11] 4,368,223

[45] Jan. 11, 1983

[54] PROCESS FOR PREPARING NICKEL LAYER

[75] Inventors: Takayuki Kobayashi; Ryo Tamamura, both of Yokohama, Japan

[73] Assignee: Asahi Glass Company, Ltd., Tokyo, Japan

[21] Appl. No.: 268,837

[22] Filed: Jun. 1, 1981

[51] Int. Cl.[3] ..... C23C 3/02

[52] U.S. Cl. ..... 427/443.1; 106/1.22; 106/1.27; 427/305; 427/426; 427/427; 427/438; 427/168; 427/169; 427/161

[58] Field of Search ..... 427/427, 426, 438, 443.1, 427/305, 161, 168, 169; 106/1.22, 1.27

[56] References Cited

U.S. PATENT DOCUMENTS

| | | | |
|---|---|---|---|
| 2,956,900 | 10/1960 | Carlson | 427/427 |
| 3,234,031 | 2/1966 | Zirngiebl | 427/306 |
| 3,373,054 | 3/1968 | Lang | 427/438 |
| 3,672,939 | 6/1972 | Miller | 427/305 |
| 4,065,626 | 12/1977 | Franz | 427/305 |
| 4,301,196 | 11/1981 | McCormack | 427/305 |

*Primary Examiner*—John D. Smith

*Attorney, Agent, or Firm*—Oblon, Fisher, Spivak, McClelland & Maier

[57] ABSTRACT

A nickel layer is prepared by applying a nickel salt and a reducing agent for reducing said nickel salt, on a substrate and reducing said nickel salt by a chemical reaction. The chemical reduction is carried out in the presence of at least one compound selected from the group consisting of diethylenetriamine, and imidazole.

9 Claims, 1 Drawing Figure

PROCESS FOR PREPARING NICKEL LAYER

BACKGROUND OF THE INVENTION

1. Field of the invention

The present invention relates to a process for preparing a nickel layer by chemical plating.

2. Description of the Prior arts

Glass plates having each thin transparent or translucent metal layer made of silver, nickel or aluminum which reflect or intercept heat radiation of solar or radiant heat have been known as heat radiation reflecting glass plates and have been used as a single glass plate, a double layer glass plate or a laminated glass plate in buildings, vehicles and various apparatuses and instruments. Among these metal coated glass plates, the glass plate having a nickel layer has superior heat radiation reflectivity and superior durability to the glass plates having the other metal layer and has a transparent neutral grey color and accordingly, it is one of excellent heat radiation reflecting glass. The nickel layer of said glass plate is usually formed by a vacuum evaporation process, a sputtering process, or a chemical plating process. Among them, the chemical plating process for applying a nickel salt and a reducing agent on a glass plate and reducing said nickel salt by a chemical reaction to form a nickel layer on the glass plate has various advantages that the nickel layer can be formed at an ambient temperature, and it can be formed for a short time in high productivity and it can be easily formed without using an expensive apparatus as required in the vacuum evaporation process or the sputtering process. The chemical plating process, however, has disadvantages that a rate of deposition is not easily controlled and a nickel layer having a desired thickness or uniform thickness is not easily formed and color unevenness is caused, and pinholes are caused and a uniform dense layer is not easily formed.

SUMMARY OF THE INVENTION

It is an object of the present invention to provide a process for preparing a nickel layer having excellent characteristics without the above-mentioned disadvantages by a chemical plating process.

The foregoing and other objects of the present invention have been attained by providing a process for preparing a nickel layer by applying a nickel salt and a reducing agent for reducing said nickel salt on a substrate and reducing said nickel salt by a chemical reaction, in the presence of at least one compound selected from the group consisting of diethylenetriamine, ethylenediamine and imidazole.

DETAILED DESCRIPTION OF THE PREFERRED EMBODIMENTS

Figure 1:
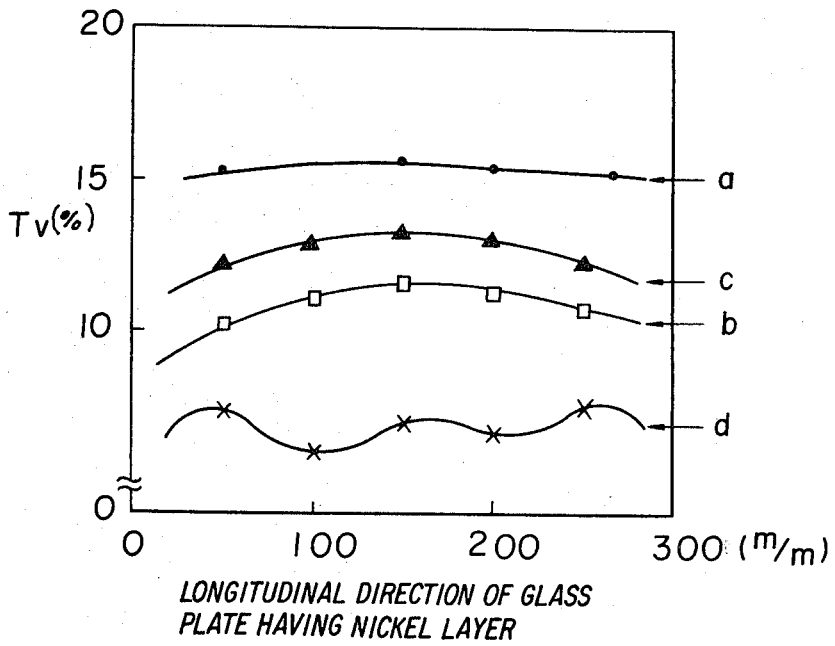

A substrate made of glass, plastic or ceramic etc. is usually treated by a sensitizing treatment or an activating treatment before the chemical plating process of the present invention. The typical treatment is a treatment for contacting the substrate with an aqueous solution of a stannous salt after water washing and further contacting it with an aqueous solution of a palladium salt.

The typical process for preparing a nickel layer on the substrate is a process for spraying or coating a chemical nickel plating solution comprising a nickel salt and a reducing agent and if necessary, the other additive such as a chelating agent, a pH buffering agent, a pH modifier, a stabilizer etc. on the substrate and forming the nickel layer on the substrate by a chemical reduction or a process for spraying both of a nickel plating solution comprising a nickel salt and if necessary the other additive such as a chelating agent, pH buffering agent, a pH modifier etc. and a solution comprising a reducing agent and a stabilizer on a glass surface and forming a nickel layer on the substrate by a chemical reduction.

The nickel salts used in the process of the present invention can be inorganic or organic water soluble nickel salts such as nickel chloride, nickel sulfate, nickel acetate, nickel bromide, nickel iodide or a mixture of at least two nickel salts. The nickel salt is usually used in a form of an aqueous solution. It is also possible to use the nickel salt in a form of an organic solvent solution or a solution of an organic solvent with water.

In the solution of a nickel salt, it is possible to incorporate a pH modifier which results in an alkaline condition and a chelating agent such as Rochelle salt, EDTA, sodium citrate and sodium gluconate, and a pH buffering agent such as malic acid and/or boric acid so as to easily perform the chemical reduction.

The typical reducing agents can be sodium borohydride, potassium borohydride, formaldehyde, sodium hypophosphite, hydrazine, hydrazinium sulfate, glyoxal, dimethylamine borazane, hydrosulfite, diethyl borazane or a mixture of at least two reducing agents with a stabilizer.

A concentration of a nickel salt in an aqueous solution of a nickel salt used in the process of the present invention is preferably in a range of about 0.1 to 10%.

In the process of the present invention, diethylenetriamine, imidazole or a mixture thereof is incorporated in the chemical reduction of the nickel salt.

In the embodiments, diethylenetriamine, and/or imidazole is incorporated as an additive in a solution of a nickel salt a solution of a reducing agent or a nickel plating solution containing both of a nickel salt and a reducing agent or diethylenetriamine, and/or imidazole is applied in a chemical reduction. Diethylenetriamine, and/or imidazole can be present in the chemical reduction of the nickel salt to deposit the nickel layer. Therefore, the other methods of incorporating the additive can be employed.

A concentration of diethylenetriamine, and/or imidazole is preferably in a range of 1 to 1,000 ppm based on a solution of a nickel salt when the additive is mixed with the nickel salt. An amount of diethylenetriamine, and/or imidazole is in a range of 0.02 to 20 wt. % based on the nickel salt.

When diethylenetriamine, and/or imidazole is incorporated in the chemical reduction of the nickel salt, a nickel layer having high density, and a uniform thickness without pinhole can be formed. The reason is not clear, however, it is considered to result fine nickel grains deposited by the chemical reduction. Diethylenetriamine imparts especially superior effect.

A time for plating in the deposition of the nickel layer by the chemical plating process is usually in a range of 30 sec. to 10 min. preferably about 1 min. to 5 min.

A temperature of the solution of a nickel salt, the solution of a reducing agent or the solution of a nickel salt and a reducing salt in the deposition of the nickel layer by the chemical plating process is usually in a range of 10° C. to 60° C. especially about 30° C. The rate of nickel deposition is varied depending upon the temperature in the chemical plating whereby it is important to maintain the temperature in the chemical plating in constant such as in a range of ±3° C. so as to prevent unevenness of color. The temperature of the substrate during chemical plating is usually in a range of 10 to 60° C. preferably about room temperature.

A thickness of the nickel layer formed in the process of the present invention can be selected to be transparent or translucent and to give desired optical characteristics such as desired heat radiation reflectivity and transmissivity etc. and is preferably in a range of 100 to 1000 A. A composition a flow rate of the plating solution, a plating time and a temperature are selected so as to give a desired thickness of the nickel layer.

In the preparation of the nickel layer of the present invention, it is possible to form a composite layer of nickel and the other metal by incorporating a salt of the other metal such as copper, cobalt, iron, silver, gold and platinum together with the nickel salt.

The present invention will be further illustrated by certain examples and references which are provided for purposes of illustration only and are not intended to be limiting the present invention.

EXAMPLE 1

A glass plate (300 mm×300 mm×5 mm) was polished with ceria and rinsed with water. An aqueous solution of stannous chloride ($SnCl_2.2H_2O$: 1 g/1 liter of water) was sprayed on the surface of the glass plate to perform a sensitizing treatment for 30 seconds and then, the glass plate was rinsed with water and an aqueous solution of palladium chloride ($PdCl_2.nH_2O$: 0.05 g/1 liter of water; 1.0 ml of 35% HCl/1 liter of water) was sprayed on the surface of the glass plate to perform an activating treatment for 30 seconds and then, the glass was rinsed with deionized water.

The following aqueous solution of the nickel salt and the solution of the reducing agent (30° C.) were respectively sprayed on the treated surface of the glass plate at 30° C. by each spray-gun at each rate of 0.64 liter/min. and they were kept for 2 minutes to deposit a nickel layer on the glass plate.

Aqueous Solution of Nickel Salt

Nickel acetate: 5.0 g./liter
Sodium gluconate (chelating agent): 9.0 g./liter
Ammonia water (39%) (pH modifier): 2.0 ml./liter
Boric acid (pH buffering agent): 2.5 g./liter
Diethylenetriamine: 0.015 ml./liter Solution of Reducing Agent Sodium borohydride: 0.5 g./liter
Sodium hydroxide (stabilizer for a reducing agent): 0.2 g./liter The resulting nickel layer formed on the glass plate had a thickness of 500 A and was a dense uniform layer without any pinhole and had uniform color distribution shown by the curve (a) in FIG. 1 as visible transmissivity $T_V$ in the longitudinal direction of the glass plate having nickel layer.

The optical characteristics of the glass plate are shown in Table 1.

EXAMPLE 2

A glass plate (300 mm×300 mm×5 mm) was polished with ceria and rinsed with water. An aqueous solution of stannous chloride ($SnCl_2.2H_2O$: 1 g./1 liter of water) was sprayed on the surface of the glass plate to perform a sensitizing treatment for 30 seconds and then, the glass plate was rinsed with water and an aqueous solution of palladium chloride ($PdCl_2.nH_2O$: 0.05 g./1 liter of water; 1.0 ml of 35% HCl/1 liter of water) was sprayed on the surface of the glass plate to perform an activating treatment for 30 seconds and then, the glass plate was rinsed with deionized water.

The following aqueous solution of the nickel salt and the solution of the reducing agent (30° C.) were respectively sprayed on the treated surface of the glass plate at 30° C. by each spray-gun at each rate of 0.64 liter/min. and they were kept for 2 minutes to deposit a nickel layer on the glass plate.

Aqueous Solution of Nickel Salt

Nickel acetate: 5.0 g./liter
Sodium gluconate (chelating agent): 9.0 g./liter
Ammonia water (39%) (pH modifier): 2.0 ml./liter
Boric acid (pH buffering agent): 2.5 g./liter
Imidazole: 0.5 g./liter Solution of Reducing Agent Sodium borohydride: 0.5 g./liter
Sodium hydroxide (stabilizer for a reducing agent): 0.2 g./liter The resulting nickel layer formed on the glass plate had a thickness of 500 A and was a dense uniform layer without any pinhole and had uniform color distribution shown by the curve (b) in FIG. 1.

The optical characteristics of the glass plate are shown in Table 1.

REFERENCE

In accordance with the process of Example 1 except that diethylenetriamine was eliminated from the aqueous solution of the nickel salt, a nickel layer was formed on the surface of the glass plate.

The resulting nickel layer formed on the glass plate had a thickness of 700 A and had color distribution shown by the curve (c) in FIG. 1.

TABLE 1

| | $T_V$(%) | $R_V$(%) | $T_E$(%) | $R_E$(%) | Pinhole |
|---|---|---|---|---|---|
| Example 1 | 15.5 | 37.6 | 15.6 | 37.5 | none |
| Example 2 | 13.3 | 30.6 | 15.0 | 36.5 | none |
| Reference | 7.0 | 39.2 | 5.2 | 35.0 | many |

Note:
$T_V$: visible transmissivity
$R_V$: visible reflectivity
$T_E$: solar energy transmissivity
$R_E$: solar energy reflectivity The optical characteristics were respectively measured under the light incidence from each nickel layer of each sample of glass plate having a thickness of 5 mm.

FIG. 1 shows color distributions of nickel layers of the samples.

As it is shown in Table 1 and FIG. 1, the nickel layer having the uniform color distribution and less pinhole can be obtained in accordance with the process of the present invention.

We claim:

1. In a process for preparing a transparent nickel layer by applying a solution containing a nickel salt and a reducing agent for the reduction of said nickel salt onto a substrate and reducing the nickel salt by a chemical reaction, the improvement comprising:

conducting said chemical reduction with a solution containing from 0.02 to 20 wt % of diethylenetriamine or imidazole based on the amount of said nickel salt which enhances the visible and solar energy transmissivity values of the transparent layer.

2. The process of claim 1, wherein said reducing agent is sodium borohydride, potassium borohydride, formaldehyde, sodium hypophosphite, hydrazine, hydrazinium sulfate, glyoxal, dimethylamine borazane, hydrosulfite, diethylborozane or mixtures thereof.

3. The process of claim 1, wherein the concentration of nickel salt in solution is about 0.1 to 10%.

4. The process of claim 1, wherein said plating is conducted at a temperature in the range of 10° C. to 60° C.

5. The process of claim 1, wherein said nickel salt is nickel chloride, nickel sulfate, nickel acetate, nickel bromide, nickel iodide or mixtures thereof.

6. The process of claim 1, wherein said solution further contains a chelating agent selected from the group consisting of Rochelle salt, ethylenediaminetetraacetic acid, sodium citrate and sodium gluconate.

7. The process of claim 1, wherein said solution contains malic acid, boric acid or mixtures thereof as a buffering agent.

8. The process of claim 1, wherein the concentration of said diethylenetriamine or imidazole in solution ranges from 1 to 1000 ppm.

9. In a process for preparing a transparent nickel layer by applying a solution containing a nickel salt and a reducing agent for the reduction of said nickel salt onto a substrate and reducing the nickel salt by a chemical reaction, the improvement comprising:

conducting said chemical reduction with a solution containing from 0.02 to 20 wt % of imidazole based on the amount of said nickel salt which enhances the visible and solar energy transmissivity values of the transparent layer.

* * * * *